United States Patent [19]

Sweda et al.

[11] 4,029,349

[45] June 14, 1977

[54] DOOR HARDWARE

[75] Inventors: Adam D. Sweda, Rochester; Donald M. Wilde, Mount Clemens, both of Mich.

[73] Assignee: Fruehauf Corporation, Detroit, Mich.

[22] Filed: Mar. 22, 1976

[21] Appl. No.: 668,785

Related U.S. Application Data

[63] Continuation of Ser. No. 566,244, April 9, 1975, abandoned.

[52] U.S. Cl. ..... 292/241; 292/67; 292/218; 292/DIG. 32; 292/DIG. 55

[51] Int. Cl.[2] ..... E05C 3/14

[58] Field of Search ..... 292/31, 54, 56, 67, 292/114, 101, 120, 240, 241, 242, 218, DIG. 32, DIG. 57, DIG. 55; 70/464

[56] References Cited

UNITED STATES PATENTS

| | | | |
|---|---|---|---|
| 1,019,036 | 3/1912 | Gaines | 292/DIG. 32 |
| 1,037,125 | 8/1912 | Carmer | 292/120 |
| 1,692,295 | 11/1928 | Gerard | 292/114 |
| 2,301,444 | 11/1942 | Olander | 292/DIG. 32 |
| 3,134,618 | 5/1964 | Heimann | 292/DIG. 32 |
| 3,329,456 | 7/1967 | Olander | 292/218 |
| 3,434,751 | 3/1969 | Tantlinger et al. | 292/218 |
| 3,464,729 | 9/1969 | Chambers | 292/218 |
| 3,549,185 | 12/1970 | Lynn | 292/218 |
| 3,801,146 | 4/1974 | Donath et al. | 292/218 |
| 3,806,173 | 4/1974 | Sweda | 292/DIG. 32 |

*Primary Examiner*—Roy D. Frazier
*Assistant Examiner*—Rodney H. Bonck
*Attorney, Agent, or Firm*—Harness, Dickey & Pierce

[57] ABSTRACT

Fastening means for a hinged door consists of a locking cam shaped like an elongated hooked finger, swingable about a vertical axis to and from overengaged relation with a keeper pin to secure and release the door. The cam is tapered to reduced vertical thickness toward its free end and is keystone-shaped in cross section. The keeper pin is contained in a keeper housing into and out of which the cam moves. The keeper housing has wall portions with which the cam is engageable if the door is sagged or misaligned, so that due to its tapered form the cam urges the door toward realignment during closing. Due to the cross-sectional shape of the cam, the area of contact between the cam and such wall portions of the housing is limited (theoretically to a point) during movement of the cam to and from the locked position.

7 Claims, 8 Drawing Figures

DOOR HARDWARE

REFERENCE TO PRIOR RELATED APPLICATION

This application is a continuation of U.S. application Ser. No. 566,244, filed Apr. 9, 1975, now abandoned.

BACKGROUND OF THE INVENTION

In the construction of door closures for the heavy service encountered in large cargo containers, closed bodies for heavy trucks, semi-trailers and the like, where swinging doors are employed, as is commonly desirable at the rear ends of such bodies and containers, it is important that the mechanisms for securing and releasing the doors be of extremely rugged and reliable construction, operable in minimum time and with minimum difficulty under severe and abnormal conditions which arise in such service due to factors such as distortion, or sagging of one of the doors, the presence of ice, dirt and the like in the mechanism, etc. A successful fastening system employed with paired-hinged doors utilized upon heavy containers and bodies of the indicated character, comprises a vertical lock rod on each door near the free edge and projecting above and below the door to overlie the header and sill, each projecting end of the rod carrying fast thereon a hooked finger-like cam which when the rod is rotated by an actuating handle is swingable into and out of overengaged relation with respect to a keeper abutment in a keeper box on the header or sill to pull the door to and secure it in or release it from the fully-closed position. The keeper box is a rugged casting having a relatively narrow opening and the cam, which is somewaht narrower than the keeper box, is tapered to reduced thickness toward its ends in its dimension parallel to its axis of swinging movement. If the door has sagged or become misaligned, but the misalignment is not so great as to eliminate all overlap between the free end of the cam and the opening in the box, the cam, as it is forced into the keeper box, bears against the top or bottom wall of the box and exerts a camming force tending to urge the door into proper alignment with the door opening. Practical considerations including cost and available space militate against the use of anti-friction bearings or ground and polished surfaces on the interengaging parts. Lubricants must also be avoided because of the fact that they become fouled with dust and dirt. Under some conditions when it is necessary to force the cams into the receptacles with great force in order to correct a misaligned condition, it has been difficult to overcome the friction. If the operator exerts great force on the operating handle, as by applying a long pipe as a lever, or otherwise overstressing the parts, damage may be caused to the lock mechanism, despite the construction thereof of heavy steel parts in the most rugged manner feasible.

A primary object of the present invention, therefore, is to provide an improved construction of the indicated character which in a very simple and inexpensive manner overcomes the difficulty indicated, greatly reduces the friction caused by misalignment of the parts, and enables moving the cams into and out of the keeper receptacles easily under virtually all conditions encountered in service.

Other objects and advantages will become apparent upon consideration of the present disclosure in its entirety.

BRIEF DESCRIPTION OF THE FIGURES OF DRAWING

Figure 3:
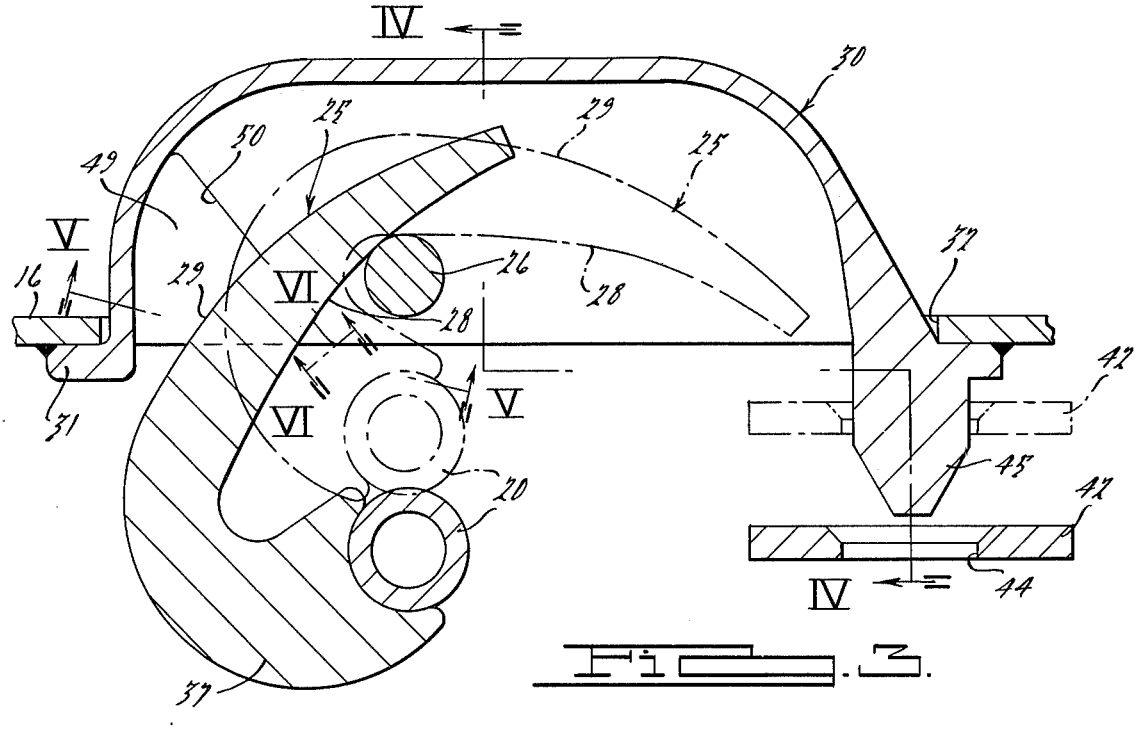
FIG. 3 is a sectional plan view taken substantially on the line III—III of FIG. 2 and looking in the direction of the arrows, but showing the locking parts in a partially engaged position.
Figure 8:
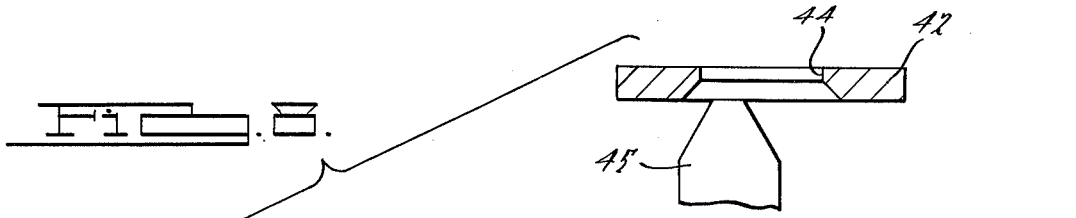
Figure 7:
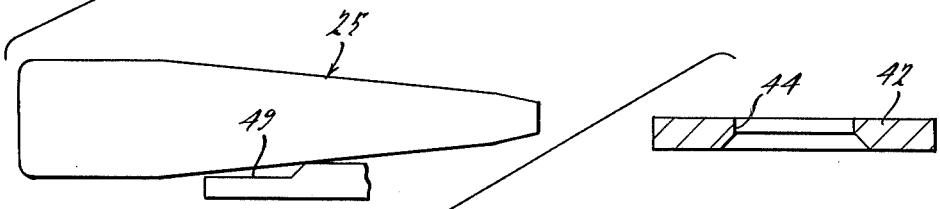
Figure 6:
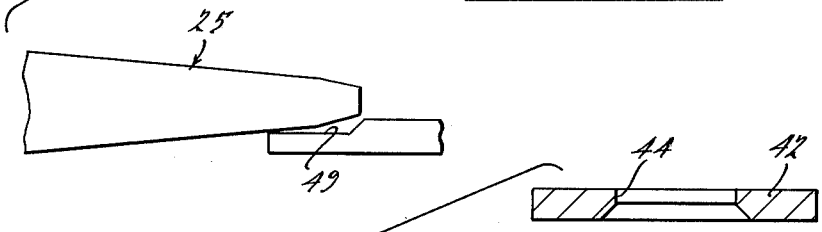
Figure 5:
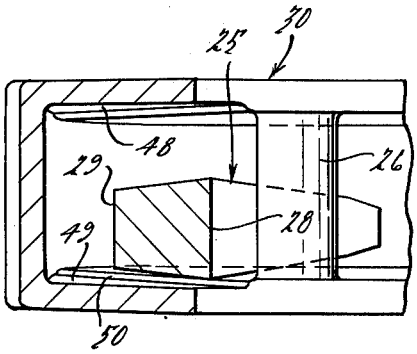

FIG. 5 is a sectional elevational view taken substantially on the line V—V of FIG. 3; and FIGS. 6, 7 and 8 are diagrammatic views corresponding generally to a cross section taken substantially on the line VI—VI of FIG. 3 and looking in the direction of the arrows, showing the relationship between the cam and the keeper as they move toward fully engaged relationship while the parts are misaligned, also showing the relative positions of the anti-rack parts, the latter parts being rotated out of their normal positioning.

DETAILED DESCRIPTION OF THE PREFERRED FORM OF THE INVENTION

Reference characters 10 and 11 designate generally the left and right rear doors, respectively, of a large cargo container body 15. Each door is hinged along its outer edge to a jamb 12, 13 forming part of the rear cornerpost structure of the body. The door frame is completed by transverse sill and header members 16, 18 affixed to the cornerposts.

At a position relatively closed to but spaced from its free edge each door carries a vertical actuating rod in the form of a rockshaft, 20, 21 which when the doors are closed projects downwardly at its lower end to overlie the sill 16 and at its upper end projects upwardly to overlie the header 18. Each rockshaft is journaled for rotation about its longitudinal axis in suitable bearing brackets 22 secured to the outer face of the door.

Each projecting end of the rockshaft carries fast thereon a locking cam 25 having the general contour of a curved elongated finger and which is swingable horizontally when the rockshaft is rotated by means of the actuating handle 23, so that it can be selectively moved into and out of holding overengagement with respect to a keeper pin 26. One such keeper pin is provided for each cam, rigidly mounted on the sill or header, as the case may be, in a box-like keeper housing 30 having an open face directed outwardly in position to receive the cam. The cams and keeper assemblies are alike, so that description of one will suffice. The keeper housing is welded in an opening as 32 in its supporting sill or header, and has end flanges as 31 which overlie the sill or header.

Each door also carries, closer to its free edge, a vertical box-like reinforcing rib member 40, which extends the full height of the door and is secured thereto at a plurality of positions. A rigid plate 42, forming an extension of such rib member extends upwardly or downwardly therefrom, as the case may be, to overlie the header or sill, and contains an aperture 44 overengageable, when the door is closed, with a rigid bosslike projection 45 integral with the keeper housing 30. The aperature 44 is guided onto a tapered end portion (undesignated) of the boss 45 if this is necessary during the final portion of closing, to asist in bringing the door into alignment, and parts 42, 45 perform the function of preventing so-called rack-type distortion when the doors are closed.

The features thus far described in this Detailed Description do not in themselves form a part of the present invention. Features thereof are claimed in the copending application of Steven J. Ringe, Ser. No. 566,237, filed Apr. 9, 1975. Said application, and U.S. Pat. No. 3,806,173 may also be referred to as typifying closure, frame and fastening means of the type with which the present invention is advantageously used.

Figure 1:
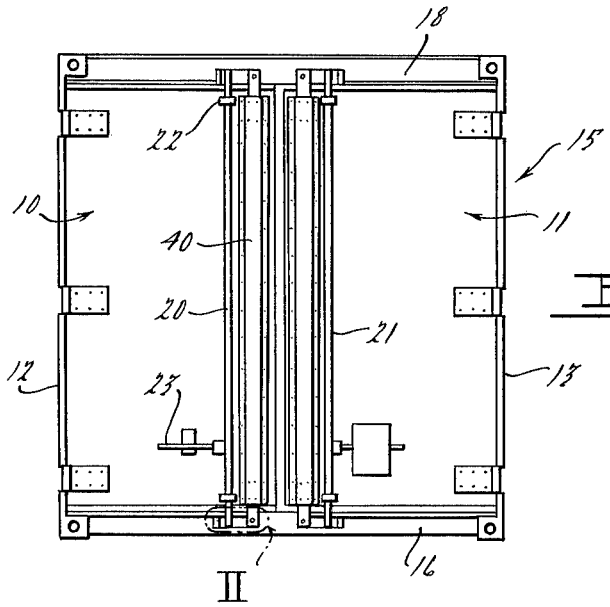
FIG. 1 is a rear elevational view of a large cargo container equipped with door hardware incorporating the present invention.
Figure 2:
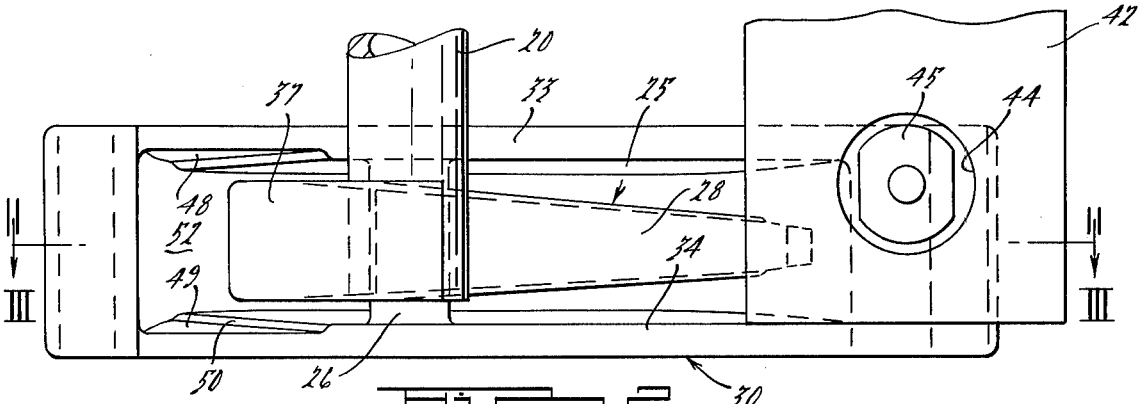
FIG. 2 is a fragmentary elevational view on a larger scale of the portions contained within the dotted enclosure designated II in FIG. 1.

As shown in FIGS. 2, 3 and 8, the cam 25 has a portion 37 of full thickness at and near its hub and tapers to reduced thickness toward its free end in the vertical dimension as well as in the horizontal dimension. In accordance with the present invention, the portion of the cam extending away from the full thickness portion has a cross-sectional shape corresponding to a regular trapezoid, with its parallel sides vertical, as best brought out in FIG. 5. Such trapezoidal or keystone-shaped cross section extends for substantially the full effective length of the active portion of the cam, from a position near the free end to the full thickness portion 37. Portion 37 is secured to the rockshaft 20 as by welding. The longer vertical dimension of the parallel side of the trapezoidal-sectioned part is located on the inner surface of the cam, that is, the side which effectively engages and bears against the keeper pin 26.

The top and bottom walls 33, 34 of the keeper housing 30 are spaced apart a distance somewhat exceeding the maximum vertical thickness of the cam, and substantially exceeding the thickness of the free end of the cam. In the entrance area or region where the cam enters and leaves the housing, to the left of the keeper pin 26, as shown in FIGS. 2, 3 and 5, each of the walls 33, 34 is internally relieved to a thinned cross section for a portion of the distance inwardly from its open face, creating an enlarged entrance passage area 52. Each such thinned section, which is designated 48 on the top wall and 49 on the bottom wall, terminates at a diagonal line which defines a shoulder 50 extending inwardly in a straight line at an angle of approximately 45° from the open face of the housing and at a position which is radial with respect to the axis of the rockshaft when the door is closed. The greater spacing between the walls at the open face of the entrance area provides increased "gathering range" for the cam in event of extreme misalignment, without weakening the strength of support of the keeper pin 26.

If the door is misaligned upwardly or downwardly with respect to the door opening when it is desired to close the door, which misalignment may be due either to temporary or permanent distortion or wear, and such misalignment is not so severe as to cause the nose portion 27 of the cam to be completely disaligned with the opening in the housing at the entrance area, the cam is effective to exert a wedge-like action tending to force the door and doorframe toward the aligned position, as shown in FIGS. 6, 7 and 8, as the cam is progressively forced into the keeper housing. In the operation of apparatus of this general character it was found that under such conditions of substantial misalignment, if the top and bottom surfaces of the cam were shaped in such fashion as to create line contact between the cam surface and the wall of the keeper housing, severe frictional resistance was created, apparently because of the scraping and/or biting edge contact. Such line contact tended to occur when the inner and outer surfaces of the cam (corresponding to the surfaces 28, 29) were of the same vertical dimension at corresponding longitudinal positions of the cam, so that the cam would present a rectangular cross section rather than a trapezoidal section such as is shown in FIG. 5. In the development of the present invention it was found that if the upper and lower surfaces of the cam were inclined transversely, that is, away from the axis of rotation defined by the rockshaft 20, as well as longitudinally, so that when the cam is moved inwardly and/or outwardly of the keeper housing under conditions of misalignment and rubbing against the top or bottom wall occurs, the presence of such additional keystone or wedge-type cross-sectional tapering, by reducing the area of contact between these parts (theoretically to point contact), greatly reduces the effort required to actuate the cam. Scraping or rubbing over a line of any length is prevented, friction is reduced and ease of operation substantially improved. Upon consideration of the operation of these parts it will be perceived that there is only one instantaneous position at which there is line contact, transversely of the cam, between the cam and the corner of the entrance area or the shoulder 50, as the case may be. These parts are normally made of a hard ferrous alloy which as a practical matter is not of great smoothness in the overengaging parts, but is of sufficient hardness to effectively resist the higher unit pressure. Thus, not only is scraping resistance reduced to a very low value, but any surface irregularities create much less resistance than would occur if substantial line contact were permitted. There is also a tendency of the parts to dress and remove any substantial irregularities.

Figure 4:
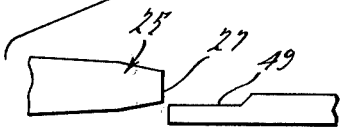
FIG. 4 is a fragmentary vertical sectional view taken as indicated by the line and arrows IV—IV of FIG. 3 and looking in the direction of the arrows, but showing the parts fully engaged.
Figure 4:
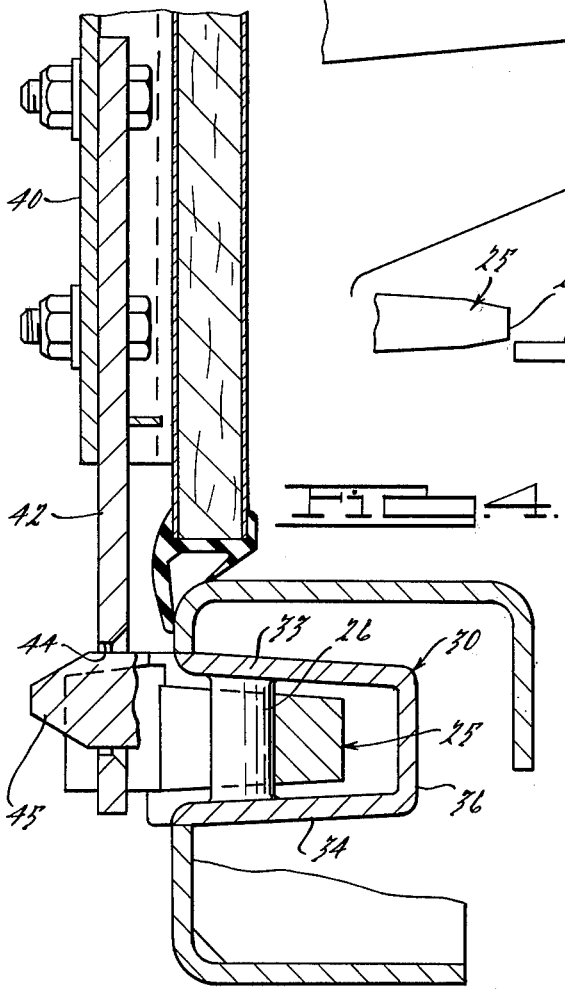

It will be recognized that the cross-sectional contouring of the cam might be varied from that shown while still practicing the principles of the present invention, so long as the upper and lower surfaces of the cam are so shaped as to be inclined in all directions in planes non-parallel to surfaces of the top and bottom walls and the corners defined by the open mouth of the entrance area and the shoulder 50, which are so engaged by the cam during misalignment. For example, the cross section might be generally diamond shaped, rather than wedge shaped. The keystone or wedge-shaped cross section shown is preferred because it places the position of contact closer to the axis of the rockshaft, and therefore minimizes the torque required to move the cam. In this regard it will be noted that the top and bottom surfaces of the cam have all portions thereof so inclined with respect to the reaction surfaces defined by the upper and lower walls of the keeper housing that no line can be drawn on either the top or bottom surface of the cam which is parallel to a line on the surface or portion of the keeper housing with which the cam is engageable to effect the alignment functioning during its inward movement in the final portion of the closing of the door, and its outward movement in the initial portion of the opening of the door. However, the top and bottom walls 33, 34 of the keeper housing slope toward one another the inner wall 36 at the same angle as the top and bottom walls of the cam, as best shown in FIG. 4. Thus when the cam is fully overengaged with the keeper pin portion 26, the closest upper and lower portions of the walls of the cam and keeper are more nearly parallel, as shown in FIG. 4. Relative vertical movements of the doors with respect to the frame structure which occur due to unavoidable distortion of the parts in traveling, and which are sometimes of a rapid or vibratory nature and which may cause impacts between the cam and keeper, cause less distortion of the parts due to a peening effect than would occur if more sharply divergent "point contact" parts referred to above remained overengaged or in contact with each other when the door was fully secured.

This Detailed Description of Preferred Form of the Invention, and the accompanying drawings, have been furnished in compliance with the statutory requirement to set forth the best mode contemplated by the inventors of carrying out the invention. The prior portions consisting of the "Abstract of the Disclosure" and the "Background of the Invention" are furnished without prejudice to comply with administrative requirements of the Patent Office.

What is claimed is:

1. Combined fastening and aligning means for a closure which is hinged to a frame, comprising a cam portion and a keeper abutment portion, one of said portions being on the closure and the other portion on the frame, the cam portion being in the general shape of a hooked finger, said cam portion having a free end swingable to and from overengaged holding relation to the keeper abutment portion about an axis parallel to the keeper abutment portion and spaced from such free end, and having surfaces transverse to the pivot axis which converge toward said free end so that said cam portion tapers to reduced thickness toward such free end, a keeper pocket-defining portion having a pair of spaced walls defining reaction portions fixedly appurtenant to the keeper abutment portion and spaced from each other a distance which is not materially greater than the maximum thickness of the cam portion in a direction longitudinally of said axis, said reaction portions being located on one side of said keeper abutment portion and defining an entrance area therebetween, the free end of the cam portion being movable into and out of the entrance area between said walls, whereby one or the other of said surfaces of the cam portion is engageable with one of said reaction portions during the initial part of its inward movement in event of misalignment between the closure and frame, to cam the closure toward realignment with the frame, characterized in that the parts of said surfaces of the cam portion and of said reaction portions which initially engage each other, as the cam portion moves into interposed relation between said reaction portions, extend away from the positions of initial engagement in different non-parallel planes, whereby such initial engagement therebetween is substantially limited to point contact, said walls having continuation portions formed as extensions of said reaction portions and located on the opposite side of said keeper abutment portion from said entrance area, the continuation portions also being spaced apart a distance which is not materially greater than the maximum thickness of the cam portion and lying substantially parallel to the closest surfaces of the cam portion when the cam portion is fully overengaged with the keeper abutment portion.

2. Means as defined in claim 1 including a keeper housing incorporating said spaced walls, said spaced walls extending parallel to each other in a direction perpendicular to a plane containing the axis of the keeper abutment portion and the axis of swinging movement of the cam portion, and converging in a direction parallel to such plane.

3. Means as defined in claim 1 wherein said cam portion is of trapezoidal cross section with its inclined sides lying on said surfaces.

4. Means as defined in claim 3 wherein the longer parallel side of the trapezoid is on the side of the cam portion which is closest to said axis, including a pair of wall portions defining said reaction portions extending parallel to each other in a direction perpendicular to a plane containing the axis of the keeper abutment portion and the axis of swinging movement of the cam portion but converging in a direction parallel to such plane at an angle corresponding substantially to the angle between inclined sides of the cam portion, and between which wall portions the cam portion is swingable, the keeper abutment portion being fixed to and bridging said wall portions.

5. Means as defined in claim 4 wherein lines on the surfaces of the cam portion which face toward said wall portions and which are radial to its axis of swinging movement are non-perpendicular to and converge in a direction away from such axis.

6. Means as defined in claim 3 wherein the longer parallel side of the trapezoid is on the side of the cam portion which is closest to said axis.

7. Means as defined in claim 1, wherein the walls defining said reaction portions in the entrance area include stepped wall areas spaced farther apart toward an open front into and out of which the cam portion is movable, and including shoulder portions joining said stepped wall areas engageable by the cam portion and extending transversely of the path of movement of the cam portion to limit the extent of possible engagement between the cam portion and wall portions and to provide increased space between the walls at the open front of the entrance area.

* * * * *